United States Patent [19]

Yasumura et al.

[11] Patent Number: 4,916,831

[45] Date of Patent: Apr. 17, 1990

[54] VACUUM ROTARY DRYER

[75] Inventors: Mitsuru Yasumura; Atsuo Ohike, both of Nishinomiya; Takao Ueda, Daito; Masayoshi Aoki, Hiratsuka; Tomio Suzuki, Manazurumachi; Makoto Horiai, Yokosuka, all of Japan

[73] Assignees: Fujisawa Pharmaceutical Co., Ltd., Osaka; Tokuju Kosakusho Co., Ltd., Tokyo, both of Japan

[21] Appl. No.: 265,701

[22] Filed: Nov. 1, 1988

[30] Foreign Application Priority Data

Nov. 2, 1987 [JP] Japan ..... 62-277599
Nov. 2, 1987 [JP] Japan ..... 62-167986

[51] Int. Cl.[4] ..... F26B 11/02

[52] U.S. Cl. ..... 34/134; 34/92; 34/135

[58] Field of Search ..... 34/92, 134, 135, 136, 34/185; 366/221

[56] References Cited

U.S. PATENT DOCUMENTS 3,992,148 11/1976 Shore et al. ..... 34/135 X
4,535,550 8/1985 Walter ..... 34/135 X
4,698,917 10/1987 DeBolini ..... 34/92

*Primary Examiner*—Henry A. Bennet
*Assistant Examiner*—John Sollecito
*Attorney, Agent, or Firm*—Oblon, Spivak, McClelland, Maier & Neustadt

[57] ABSTRACT

A rotary dryer for drying and mixing particulate material, includes a shell having a pair of conical portions and provided with a jacket to which a hot fluid may be fed, the shell defining a chamber for the material to be dried and mixed. An air-tight closure for the chamber is provided with a jacket to which hot fluid may be fed and through which the material is charged and discharged. A rotary tube shaft extends horizontally from one end of the shell and along the horizontal axis of the shell, the rotary tube shaft being sheathed by a rotary joint pipe equipped with a bearing rotatably supporting the rotary tube shaft. The rotary tube shaft is provided with a plurality of communication paths which communicate with charge/discharge ports located on the rotary joint pipe during rotation of the rotary tube shaft in the rotary joint pipe, the communication paths connecting the jackets of the shell and the closure for feeding the hot fluid. An air nozzle is disposed along the internal wall of the shell and a stirrer including a rotational mixing blade are located within the shell to agitate the material, the stirrer being supported by the wall of the shell. A feeder pipe is air-tightly inserted in the rotary tube shaft, sheathing and evacuating pipe to communicate with a vacuum line and an air supply pipe connected to said air nozzle.

5 Claims, 8 Drawing Sheets

VACUUM ROTARY DRYER

FIELD OF THE INVENTION

The present invention relates to drying technology, mixing technology, and granulating technology of bulk (i.e., particulate) material which belong to the international patent classification B 02, 05. More particularly it relates to a double cone type rotary dryer having a superior mixing function, especially for the mixing of bulk materials, which prevents the material from sticking to the inner wall surface of the dryer and also has a granulating function.

A double cone type rotary dryer provided with a double wall structure, between whose double walls a heating medium flows to dry the contents, has been conventionally used as a dryer of bulk materials. However, this type of rotary vacuum dryer only serves for the drying operation and it has no mixing function (the term "mixing" used here implies the technologies for blending different types of bulk material, for coating on particles, and for granulation). It merely rotates the drying chamber to conduct drying. The pre-mixed bulk materials or liquids to be dried enter through a charge/-discharge opening in the side wall of the drying chamber, and the dried products are discharged through the same opening.

Consequently, when one uses the equipment as a mixer or when one needs to add powders or liquids to the bulk material during the mixing process, raw materials or additives must be added by opening the charge/-discharge opening. This batch type of charging operation has the disadvantages of making fully automatic operation difficult and of putting the materials in contact with the air every time the mixer is opened, which causes insufficient mixing and difficulty in quality control.

This type of dryer also has the disadvantage that powders in particular tend to stick to the inner wall surface of the drying chamber and are heated to an abnormally high temperature, leading to a dispersion of mixing ratio.

Usually a butterfly valve is provided at the charge/-discharge opening of this type of dryer. The temperature distribution in the inner wall where the butterfly valve is installed invariably differs from that in other parts of the double cone type vacuum rotary dryer. This non-uniformity in the temperature in the dryer is a serious disadvantage for the thermal processing of bulk materials.

In short, the existing equipment only performs drying and is structurally incapable of providing a no good mixing function. Regarding the drying function, it has the problems that materials stick to the inner wall surface and that the irregular temperature distribution on the inner wall surface results in uneven drying of the materials.

SUMMARY OF THE INVENTION

The present invention has been made to cope with the aforesaid disadvantages, and the object of this invention is to present a rotary dryer which performs vacuum drying of bulk materials, preventing them from sticking to the inner wall surface, and which yields stable high quality products by low temperature vacuum drying without any thermal decomposition or any thermal degradation.

Another object of this invention is to present a rotary dryer which can be used also as a mixer and which freely allows the addition of additive powders and liquids during the mixing operation under air-tight conditions, which allow uniform mixing. The further object of this invention is to present a butterfly valve which forms a charge/discharge opening suitable for the above illustrated operations.

The above, and other, objects are accomplished according to the present invention by a rotary dryer for drying and mixing particulate material, including a shell having a pair of conical portions and provided with a jacket to which a hot fluid may be fed, the shell defining a chamber for the material to be dried and mixed. An air-tight closure for the chamber is provided with a jacket to which hot fluid may be fed and through which the material is charged and discharged. A rotary tube shaft extends horizontally from one end of the shell and along the horizontal axis of the shell, the rotary tube shaft being sheathed by a rotary joint pipe equipped with a bearing rotatably supporting the rotary tube shaft. The rotary tube shaft is provided with a plurality of communication paths which communicate with charge/discharge ports located on the rotary join pipe during rotation of the rotary tube shaft in the rotary joint pipe, the communication paths connecting the jackets of the shell and the closure for feeding the hot fluid. An air nozzle is disposed along the internal wall of the shell and stirring means including a rotational mixing blade are located within the shell to agitate the material, the stirring means being supported by the wall of the shell. A feeder pipe is air-tightly inserted in the rotary tube shaft, sheathing and evacuating pipe to communicate with a vacuum line and an air supply pipe connected to said air nozzle.

To use this equipment as a dryer or a granulator, the bulk materials to be processed are charged through the opened air-tight closure of the charge/discharge opening, and after the closure is sealed the chamber is rotated by a rotary drive motor around the supported axial shaft to conduct the drying or granulating operation.

During the drying of the materials, hot water at an appropriate temperature is sent through the flow path for hot water/hot air on the outside surface of the shell body and on the air-tight closure via the hot water charge/discharge pipes to heat and dry the contained bulk materials through the walls of the shell body and the closure.

If the inner chamber of the shell body is evacuated by the outside vacuum unit via the evacuation pipe, the drying occurs in a vacuum and at a low temperature to produce high quality products free from thermal decomposition or thermal degradation.

When the concave surface in the jacketed area at the air-tight closure is covered with a perforated plate and either of the charge/discharge pipelines is closed and a fluid such as hot air may be fed from the other of the pipelines, the hot air is jetted into the inner chamber of the shell body from the perforated plate to conduct flow-through drying.

To use this equipment as a mixer, after the bulk materials to be mixed are charged through the opened air-tight closure of charge/discharge opening, the closure is sealed and the chamber is rotated by the rotary drive motor around the supported axial shaft and the mixing blade mounted on the inner wall surface of the shell body is rotated by a rotary drive mechanism such as an air-motor to conduct the mixing operation.

Since the shell has a conical shape, the rotation of the shell body induces the repeated "press" and "disperse" motion of the bulk materials against the wall surface. This motion enhances the mixing by the rotary mixing blade.

When bulk materials or liquids must be added during the mixing operation, they are poured or distributed into the inner chamber of the shell body through the charge pipes, and after the completion of the mixing operation, they are discharged from the charge/discharge opening.

During the mixing operation, when the jacketed concave part of the air-tight closure is covered with a blind or imperforated plate and a fluid such as hot water is charged to the jacketed fluid path via feed pipe and is discharged from the discharge pipe, the hot water heats the blind plate which in turn heats the contacting materials inside the chamber of the shell body to achieve a uniform temperature distribution on the whole wall surface.

This new vacuum rotary dryer in accordance with the present invention has the advantage that it can be used as a dryer or mixer or a dryer and mixer.

Another advantage of this invention is that the addition of bulk materials and liquids during the mixing process is considerably simplified.

A further advantage is that there is no sticking of bulk materials to the inner wall surface of the shell body during mixing or drying.

A further advantage is that it achieves excellent quality control because there is no opening of the closure when charging additives.

A further advantage of this invention is that it can be used as a multi-functional piece of equipment for granulation, liquid addition, coating, and other operations because it mixes different types of bulk materials and liquids and it can add and mix them during the drying process.

The other features and advantages of this invention will be clearly understood from the following detailed description and the attached drawings.

DETAILED DESCRIPTION OF THE PREFERRED EMBODIMENT

Figure 1:
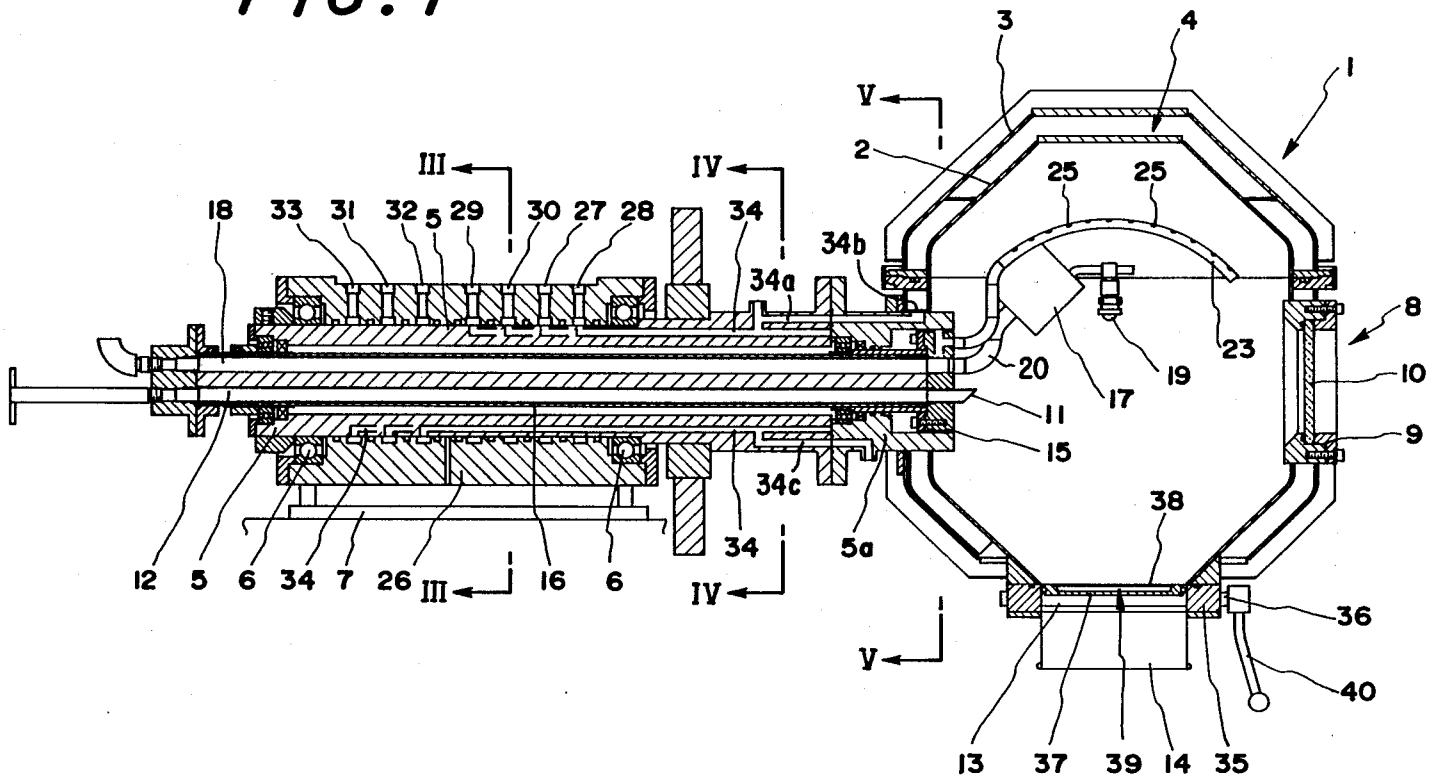
FIG. 1 is a front cross-sectional view of the whole piece of equipment representing the first embodiment of the rotary dryer of this invention.
Figure 2:
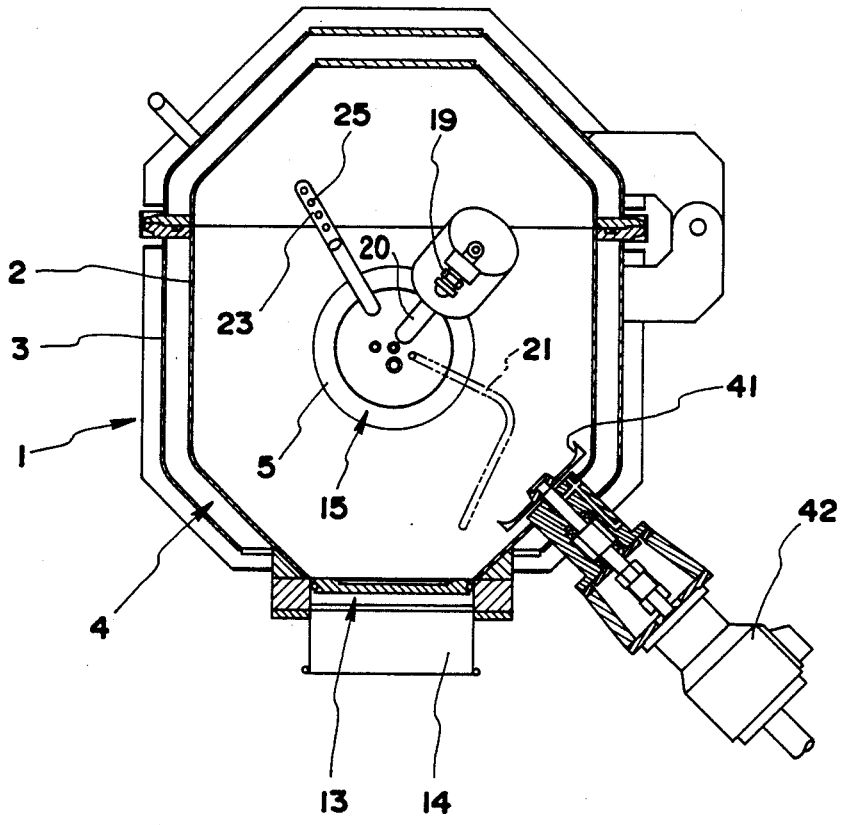
FIG. 2 is a side sectional view of the shell.
Figure 3:
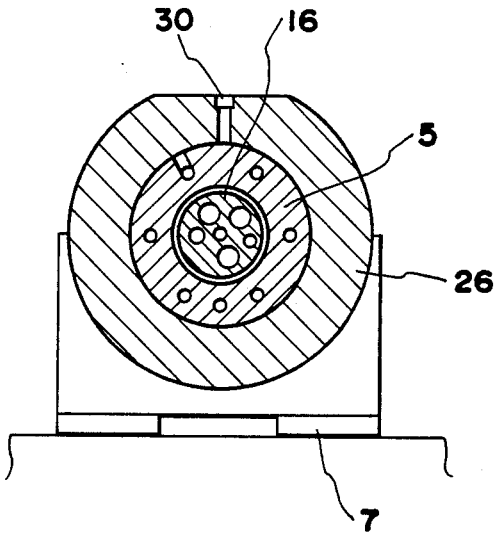
FIG. 3 is the cross-sectional view at section III—III in FIG. 1.
Figure 4:
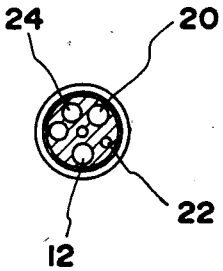
FIG. 4 is the cross-sectional view at section IV—IV in FIG. 1.
Figure 5:
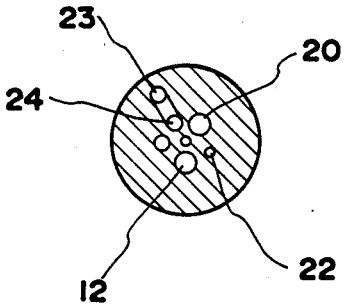
FIG. 5 is the cross-sectional view at section V—V in FIG. 1.
Figure 6:
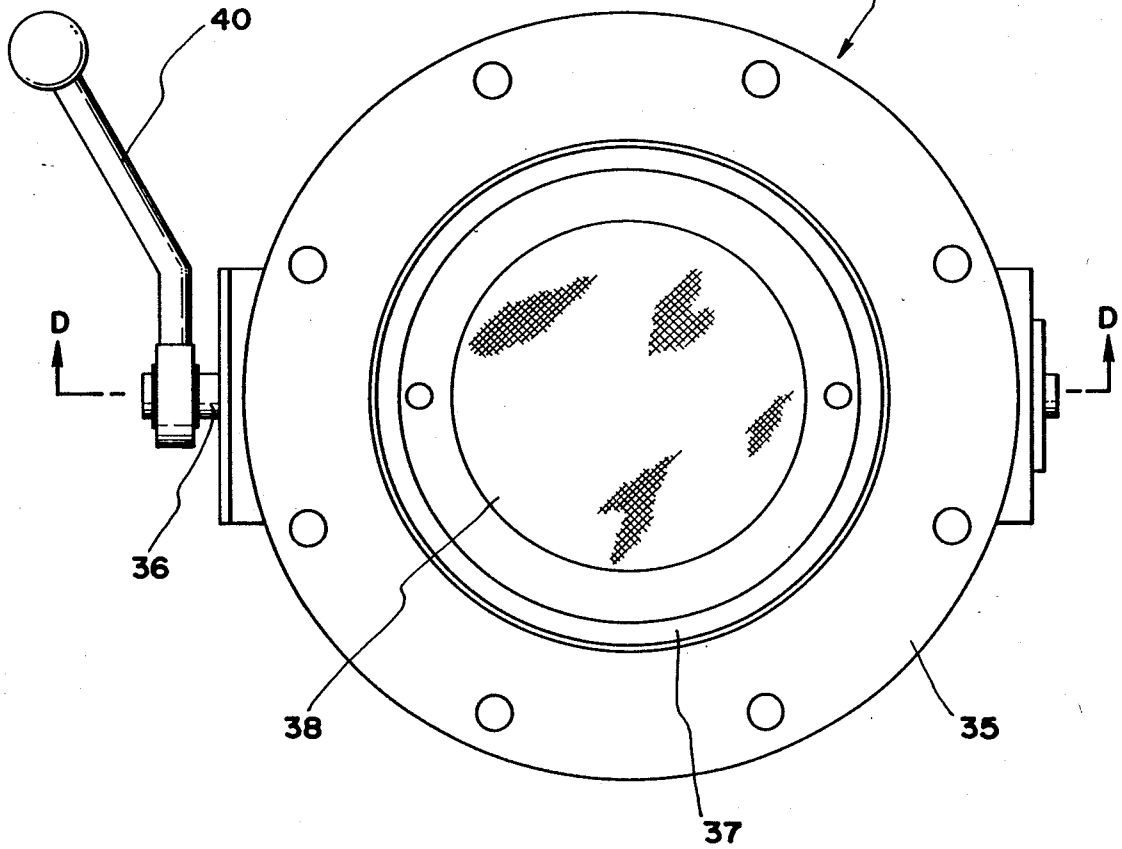
FIG. 6 is a front view of the air-tight closure.
Figure 7:
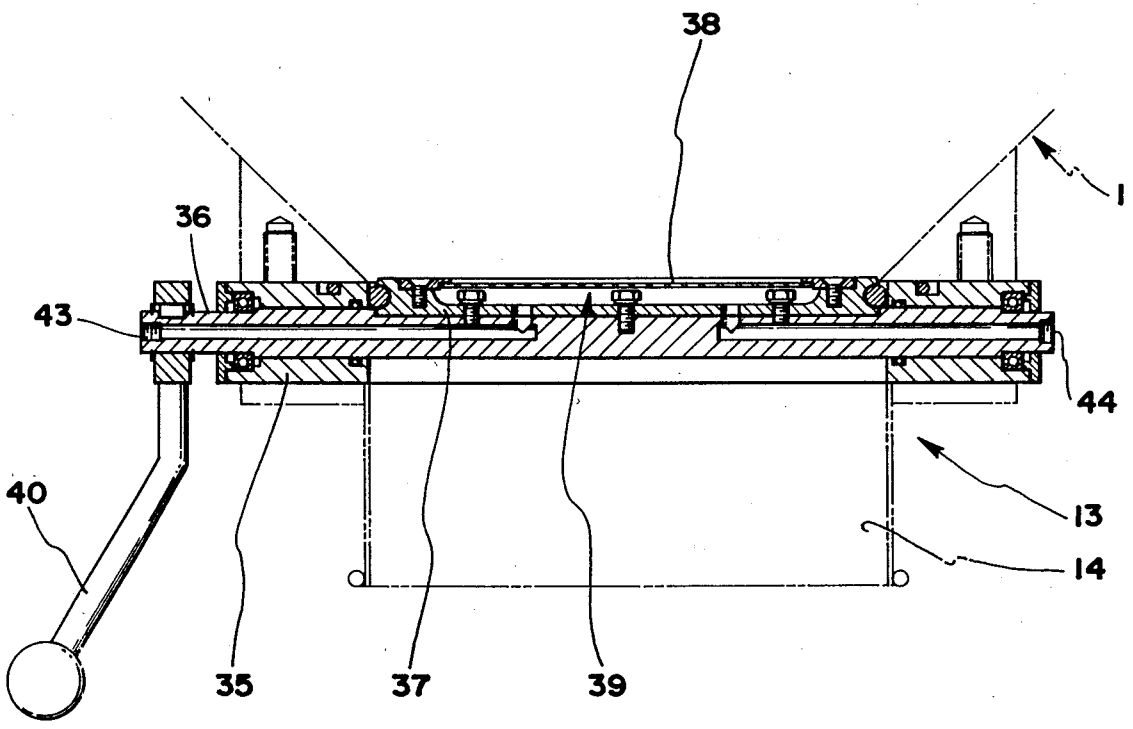
FIG. 7 is the cross-sectional view at section D—D in FIG. 6.

Following is a detailed illustration of the rotary dryer which is provided with an air-tight closure having a jacket for through-flow or charging of fluid in accordance with this invention using the figures of the embodiments.

FIG. 1 through FIG. 7 illustrate the first embodiment of this invention. Number 1 in the figures is the double structured shell which has the shell body 2 made of stainless steel or carbon steel or other materials as the inner structure and which has the jacket 3 at outside surface of the shell body 2 as the outer structure to form the flow path 4 between the shell body 2 and the jacket 3 for hot water/hot air and which has the charge/discharge opening 14 at a top of the conical shell and which has the air-tight closure 13 at the charge/discharge opening 14 in a manner to be easily opened or closed.

At one end of the shaft center of the shell 1, the flange member **5*a* is mounted to penetrate the shell 1 to connect with the rotary tube shaft 5. The rotary tube shaft 5 which is extended with an air-tight device from the flange member 5*a* is supported to freely rotate on two bearings 6, 6 which are fixed on the base 7. The rotary tube shaft 5 or the extended part is connected to an appropriate rotary drive unit (not shown) to rotate the rotary tube shaft 5** according to a predetermined program.

Number 8 in the figures is the observation window or hole in the shell 1 at one end of the rotating center axis. The observation hole 8 is formed by mounting a transparent hard glass plate 10 in a cylindrical frame 9 which penetrates the shell body 2 and the jacket 3 so that the fixture is air-tight.

In the rotary tube shaft 5 and the flange member **5*a*, a 16 is inserted in a manner that the tube shaft 5 freely rotates under air-tight conditions using a shaft seal mechanism 15** such as gland packings.

Through the feeder pipe 16, the following pipes are inserted so that the apparatus remains air-tight.

(a) The bulk material charge pipe 12 which connects with the bulk material charge nozzle 11.

(b) The evacuating pipe 18 which is provided with an air filter 17.

(c) The liquid charge pipe 20 which is equipped with the spray nozzle 19 for addition of liquids.

(d) The signal wire insertion pipe 22 which holds a signal cable to communicate with the temperature sensor 21 extended into the inside chamber of the shell body 2.

(e) The air supply pipe 24 which connects with the anti-stick air nozzle 23.

The anti-stick air nozzle 23 is curved along the curvature of the inner wall of the shell body 2 at a certain distance and has many small holes 25, 25 . . . along the line of the outer side of the curvature to form a circular arc, with the configuration of the air nozzle 23, the jetted air from many small holes 25, 25 . . . blows off any bulk materials which stick to the inner wall surface of the shell body 2.

Number 26 in the figures is the rotary joint pipe which sheathes the extended part of the rotary tube shaft 5 under air-tight and rotational conditions and which is provided with charge/discharge ports 27 and 28 for hot air or hot water to the jacket, the charge/discharge ports 29 and 30 for hot air or hot water to the air-tight closure 13, the gas charge/discharge ports 31 and 32 to the air motor 42 via path 34*c*, and the auxiliary port 33. The rotary joint 26 communicates with the hot water/hot air flow path 4 of the shell body 2 and the jacket on the air-tight closure 13 via the corresponding communication paths 34 through the rotary tube shaft 5 under the rotating condition.

Figure 10:
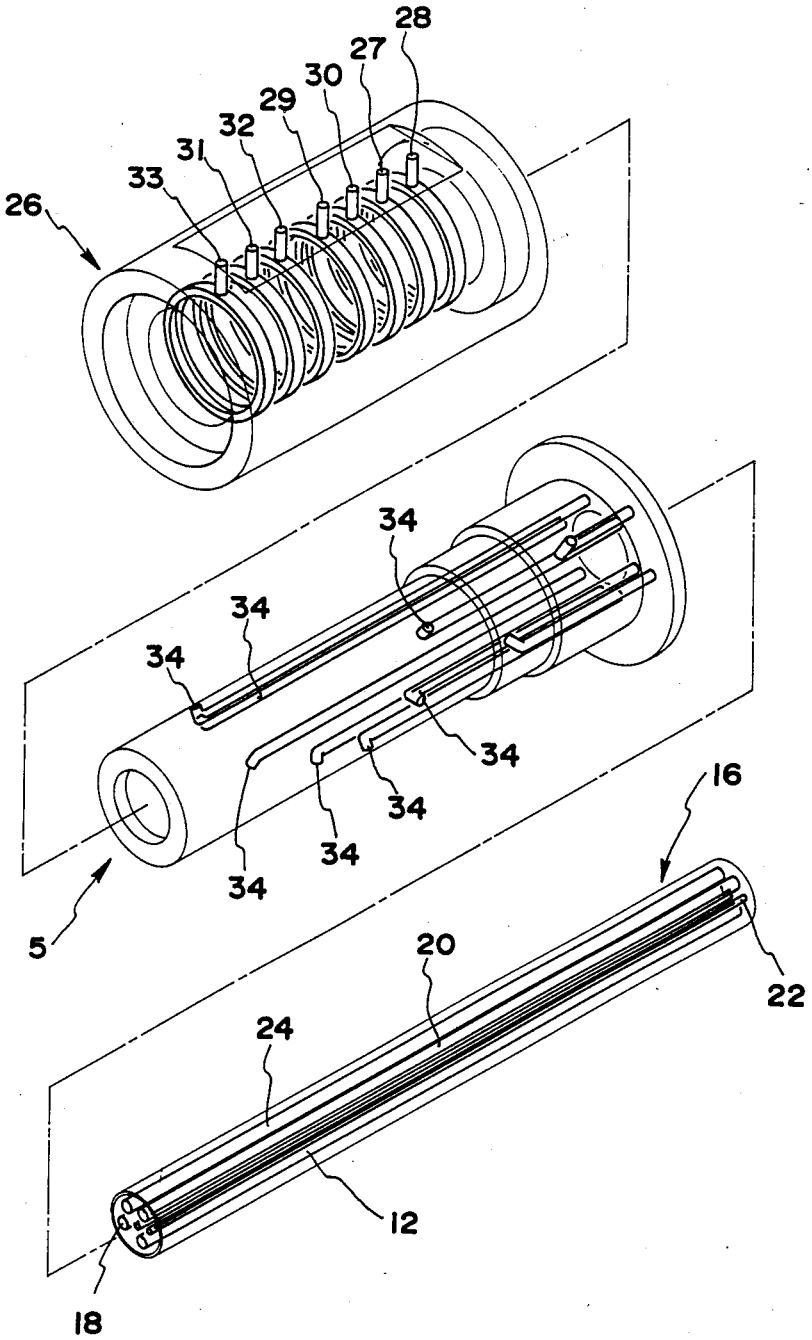
FIG. 10 is an exploded view of the rotary joint pipe, the rotary tube shaft and the feeder pipe.

As shown in FIG. 10, the rotary joint pipe 26 sheaths the rotary tube shaft 5 which is rotatably supported by bearing means 6 located on the rotary joint pipe 26. The rotary tube shaft 5 is provided with a plurality of communication paths 34. The one ends of communication paths 34 communicate with charge/discharge ports 27, 28, 29, 30, 31, 32 and 33, and the other ends are connected to the jacket 4 of the shell 1 and the jacket 39 of the closure. The path 34*a* opens into jacket 4 at 34*b*. The paths 34 for ports 29 and 30 connect to fluid paths 43 and 44. Because of the structure as shown in FIG. 10, communication paths 34 communicate with charge/discharge ports 27, 28, 29, 30, 31, 32 and 33 located on the rotary joint pipe 26 during its rotating in the rotary joint pipe, and hot water or hot air is fed to the jacket 4 and 39 through communication paths 34. The feeder pipe 16 is air-tightly inserted in the rotary tube shaft 5, and the feeder pipe sheaths the evacuating pipe 18, the air supply pipe 24, the powder material charge pipe 12, the liquid charge pipe 20, and the signal wire insertion pipe 22.

The evacuating pipe 18 is communicated with a vacuum line (not shown) when vacuum atmosphere is required in a drying process, and the air in the shell 1 is evacuated through the air filter 17 attached to the end of the evacuating pipe 18.

When the addition of a powder is required in a mixing process, the powder is supplied from the charge nozzle 11 connecting to the material charge pipe 12.

The one end of the liquid charge pipe 20 is connecting to the spray nozzle 19, and when the addition of liquid is required in mixing process, liquid is supplied from the spray nozzle 19.

The air-tight closure 13 opens and closes the charge/-discharge opening 14 on the ring support frame 35 surrounding the charge/discharge opening 14.

The rotary shaft 36 is attached to cross the ring support frame 35 at the center axis of the charge/discharge opening 14 under rotary and air-tight conditions. The closure plate 37 is attached to the rotary shaft to rotate approximately 90 degrees within the charge/discharge opening 14 and the closure plate 37 is provided with an O-ring on the periphery thereof to construct an air-tight inserted valve structure.

On the concave surface at the side of the closure plate 37, the jacketed area 39 is formed with a perforated plate 38 mounted by small screws for easy removal. The fluid charge path 43 and the fluid discharge path 44 are provided to communicate with both ends of the rotary shaft 36 and the jacketed area 39. Also, the charge/discharge ports 29 and 30 for hot air or hot water to the air-tight closure 13 communicate with the fluid paths 43 and 44 via the communication paths 34.

Number 40 in the figures is the valve operating lever which is mounted at one end of the rotary shaft 36.

Hot air is fed to the jacket 39 through charge/discharge ports 29, 30 and communication paths 34, and is supplied in the shell 1 through the perforate plate 38 to agitate the material to be dried or mixed.

Drying or mixing of the material is accelerated by this agitating action.

The perforate plate 38 is detachable, and when the plate 38 is changed to an imperforate plate, the jacket 39 is formed to circulate hot water or hot air.

Number 41 in the figures is the mixing blade which is mounted with an air-tight fitting from the outside of the shell 1 at a part of the inner wall of the shell body 2. The mixing blade 41 is driven by a rotary drive mechanism such as an airmotor 42, via lines 42*a* connected to ports 31 and 32 via the paths 34 to break up the skinned agglomerates which are formed after the granulation upon the addition of liquid to the bulk materials or to disintegrate the skinned agglomerates which are formed after the drying of granulated materials by heating through the jacket or by hot air.

The above illustrated rotary dryer dries or mixes the bulk materials by charging them into the shell body 2 through the charge/discharge opening 14 and by closing the air-tight closure 13 and by rotating or swinging the shell 1 with the rotary drive unit according to a predetermined program.

The drying process is conducted with a supply of hot water or hot air to the hot water/hot air flow path 4 on the shell body 2 and to the jacketed area 39 on the air-tight closure 13 via the charge/discharge ports 27 and 28 for hot air or hot water to the jacket and via the charge/discharge ports for hot air or hot water to the air-tight closure 13.

In addition, mixing or granulation is conducted while the additional fluids or powders are charged into the inside as needed through the bulk material charge pipe 12, the evacuation pipe 18, the liquid charge pipe 20, and the air supply pipe 24, or some combination of these pipes.

Since the shell 1 has a conical shape, the rotation of the shell body 2 induces a repeated "press" and "disperse" motion of the bulk materials against the wall surface. This motion enhances the mixing produced by the rotary motion by the mixing blade 41.

Figure 8:
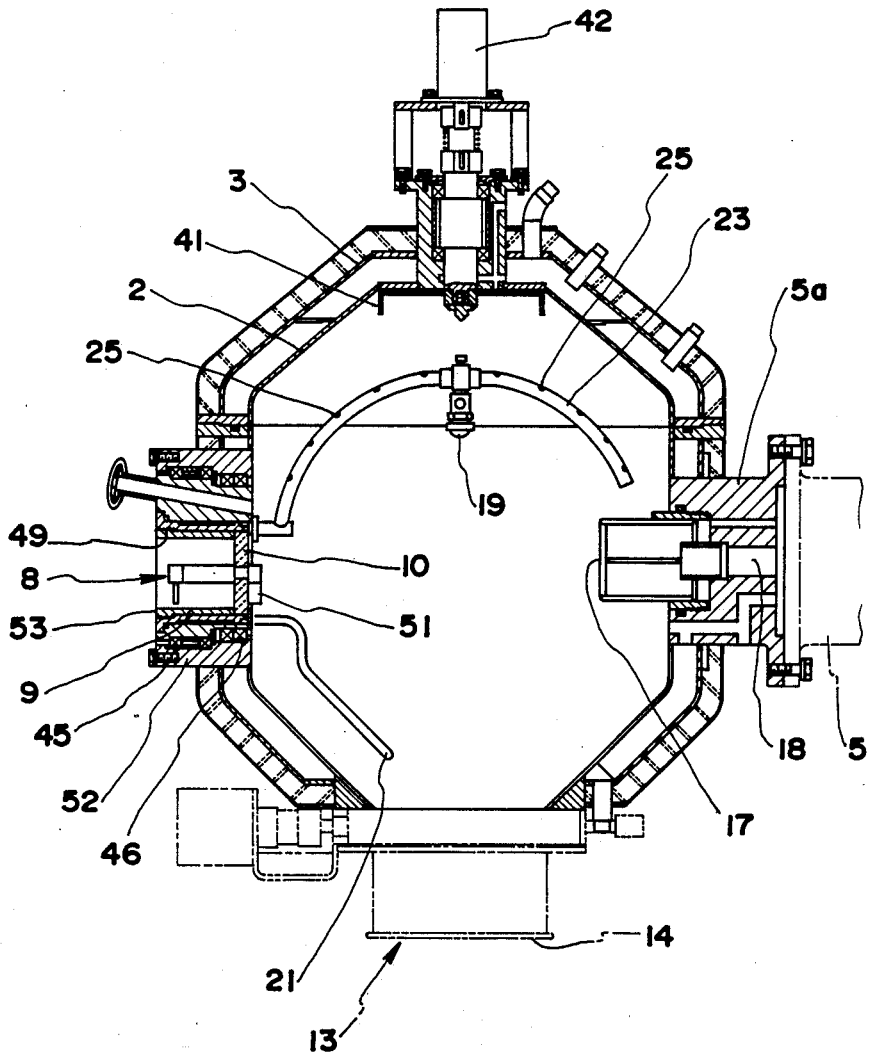
FIG. 8 is a front cross-sectional view of the shell representing the second embodiment of the rotary dryer of this invention.
Figure 9:
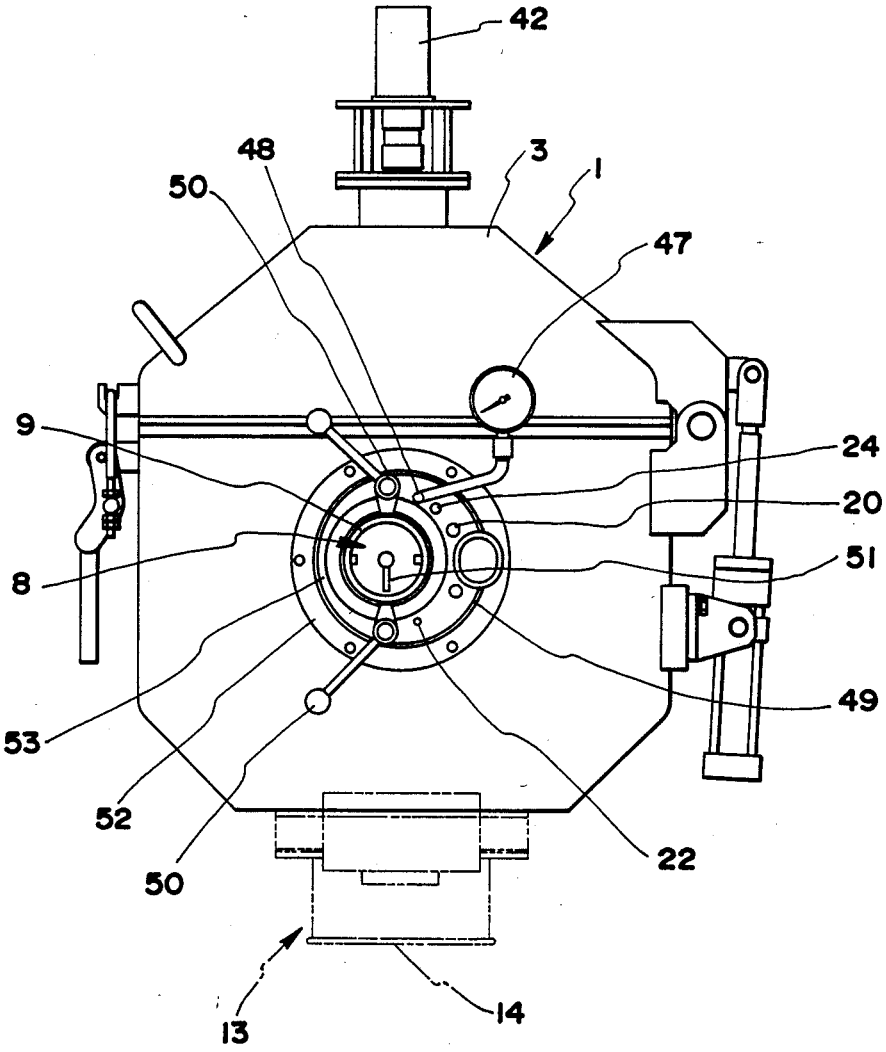
FIG. 9 is a side sectional view of the same item as in FIG. 8.

FIG. 8 and FIG. 9 illustrate the second embodiment of this vacuum rotary dryer invention.

The following is an illustration of the structures that differ from those in the first embodiment (the same numbers are used as in the first embodiment for the same functioning parts).

The double structured shell 1 which has the shell body 2 as the inner structure and the jacket 3 on the outside surface of the shell body 2 as the outer structure to form the flow path 4 between the double structures for hot water/hot air and which has the charge/discharge opening 14 at the bottom of the conical shell 1 and which has the air-tight closure 13 at the charge/discharge opening 14 in a manner to be easily opened and closed.

At the top of the conical shell opposite the opening 14, the mixing blade 41 is air-tightly mounted with an air-tight fitting from the outside of the shell 1 at a part of the inner wall of the shell body 2. The mixing blade 41 is driven by a drive mechanism such as air-motor 42.

At an end of the center axis of the shell 1, the flange member 5*a* is mounted to penetrate the shell 1 to connect with the rotary tube shaft 5. The extended part of the rotary tube shaft 5 is horizontally supported on the bearing units mounted on the base (not shown) to rotate the tube shaft 5 following a predetermined program. The evacuating pipe 18 having an air filter 17 at one end is air-tightly inserted into the rotary tube shaft 5.

At the opposite end of the center axis of the shell 1, the rotary frame 53 is mounted between the shell body 2 and the jacket 3. The rotary frame 53 rotates air-tightly inside the flange 52 which penetrates the jacket 3 and the shell body 2 to open the material charge opening 49 via the mechanical seal mechanism consisting of the bearing 45 and the oil seal 46.

The material charge opening 49 has a cylindrical frame 9 which is opened or closed by the operation of the lock handles 50, 50 and has an observation hole 8 provided with a transparent hard glass plate 10 sealed air-tight into a cylindrical frame 9. The wiper 51 is attached to the observation hole 8.

The following pipes are sealed air-tight to and pass through the flange 52: The liquid charge pipe 20 which is provided with a spray nozzle 19 for liquid addition. The signal wire insertion pipe 22 which holds a signal cable to communicate with the temperature sensor 21 extended to the inside chamber of the shell body 2. The conduit 48 which communicates with the pressure gauge 47. The air supply pipe 24 which communicates with the stick-proof air nozzle 23. The air nozzle 23 is curved along the curvature of the inner wall of the shell body 2 at a certain distance to form a circular arc and has many small holes 25, 25 . . . along the line of outer side of curvature to blow off any bulk materials stuck to the inner wall surface of the shell body 2 using the high pressure air jetted from the small holes 25.

In short, the rotary dryer having the described structure performs drying, granulation, and coating of bulk materials by charging the materials and additives through the material charge opening 49 and using the spray nozzle 19 for addition of liquids, and blows off bulk materials stuck to the inner wall surface of the shell body 2 using pressured air jetted from the stick-proof air nozzle 23 positioned against the inner wall of the shell body 2, and is automatically controlled using information output from the temperature sensor 21 and the pressure gauge 47.

The above description illustrates this invention using the most favorable embodiments. Since it is easy to give a wide variety of embodiments which present the concept and scope of this invention without any discrepancy, this invention is not restricted by any specific embodiment other than the limitations in the claims given below.

What is claimed is:

1. Rotary dryer for drying and mixing particulate material comprising:

a shell having a pair of conical portions, provided with a jacket to which a hot fluid may be fed, and defining a chamber for the material to be dried and mixed;

an air-tight closure for said chamber, provided with a jacket to which a hot fluid may be fed, and through which the material is charged and discharged;

a rotary tube shaft extending horizontally from one end of said shell and along the horizontal axis of said shell, said rotary tube shaft behind sheathed by a rotary joint pipe equipped with bearing means rotatably supporting the rotary tube shaft, said rotary tube shaft being provided with a plurality of communication paths which communicate with charge/discharge ports located on the rotary joint pipe during rotation of said rotary tube shaft in said rotary joint pipe, said communication paths connecting to said jackets of said shell and said closure for feeding the hot fluid;

an air nozzle disposed along an internal wall of said shell;

stirring means including a rotational mixing blade located within said shell to agitate the material, said stirring means being supported by the wall of the shell;

a feeder pipe air-tightly inserted in said rotary tube shaft, sheathing an evacuating pipe to communicate with a vacuum line and an air supply pipe connecting to said air nozzle.

2. A rotary dryer as defined in claim 1, including at least two interchangeable ones of an internal wall portion of the jacket of said closure.

3. A rotary dryer as defined in claim 2 in which said internal wall portion of the jacket of the closure comprises a perforated plate through which a hot fluid may be fed into the shell to agitate the material.

4. A rotary dryer as defined in claim 2 including an observation window in said shell on the longitudinal axis thereof and on a side thereof opposite said rotary tube shaft.

5. A rotary drier as defined as defined in claim 2 wherein said feeder pipe also sheaths a material charging pipe.

* * * * *